US007813930B2

(12) United States Patent
Kuboyama

(10) Patent No.: US 7,813,930 B2
(45) Date of Patent: Oct. 12, 2010

(54) INFORMATION PROCESSING APPARATUS AND INFORMATION PROCESSING METHOD FOR DETERMINING WHETHER TEXT INFORMATION OF AN OBTAINED ITEM SHOULD BE SUBJECT TO SPEECH SYNTHESIS BY COMPARING WORDS IN ANOTHER OBTAINED ITEM TO REGISTERED WORDS

(75) Inventor: Hideo Kuboyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 942 days.

(21) Appl. No.: 11/611,671

(22) Filed: Dec. 15, 2006

(65) Prior Publication Data

US 2007/0150290 A1 Jun. 28, 2007

(30) Foreign Application Priority Data

Dec. 26, 2005 (JP) ..... 2005-372429

(51) Int. Cl.
*G10L 21/00* (2006.01)

(52) U.S. Cl. ..... 704/275

(58) Field of Classification Search ..... 704/275
See application file for complete search history.

(56) References Cited

U.S. PATENT DOCUMENTS 6,615,172 B1 * 9/2003 Bennett et al. ..... 704/257
6,633,846 B1 * 10/2003 Bennett et al. ..... 704/257
6,665,640 B1 * 12/2003 Bennett et al. ..... 704/257
6,697,120 B1 * 2/2004 Haisma et al. ..... 348/515
6,820,055 B2 * 11/2004 Saindon et al. ..... 704/235
7,035,804 B2 * 4/2006 Saindon et al. ..... 704/271
7,050,977 B1 * 5/2006 Bennett ..... 704/270.1
7,117,231 B2 * 10/2006 Fischer et al. ..... 707/203
7,130,790 B1 * 10/2006 Flanagan et al. ..... 704/2
7,139,714 B2 * 11/2006 Bennett et al. ..... 704/270.1
7,145,606 B2 * 12/2006 Haisma et al. ..... 348/515
2003/0065503 A1 * 4/2003 Agnihotri et al. ..... 704/7
2006/0216922 A1 * 9/2006 Tran et al. ..... 438/618

FOREIGN PATENT DOCUMENTS

JP 5-165486 A 7/1993
JP 9-288682 A 11/1997

* cited by examiner

*Primary Examiner*—Michael N Opsasnick
(74) *Attorney, Agent, or Firm*—Canon U.S.A., Inc. I.P. Division

(57) ABSTRACT

Information including a first item and a second item is obtained and the first item of the obtained information is compared with registered words. A determination is made as to whether or not text information of the second item is to be subjected to speech synthesis. If the second item is determined not to be subjected to the speech synthesis, an item other than the second item is synthesized into speech, whereas if the second item is determined to be subjected to the speech synthesis, at least the second item is synthesized into speech.

5 Claims, 5 Drawing Sheets

FIG. 4

MONDAY, TUESDAY, WEDNESDAY, THURSDAY,
FRIDAY, SATURDAY, SUNDAY,
MOVIE, DRAMA, DOCUMENTARY,
THEATER, CINEMA, SUSPENSE,
PROGRAM GUIDE, PRO BASEBALL, SOCCER,
OPERA, MUSIC, ENTERTAINMENT,
.....

FIG. 5A

Summer Vacation unregistered word unregistered word rate of registered words 0/2 = 0%

FIG. 5B

Wednesday Cinema registered word registered word rate of registered words 2/2 = 100%

FIG. 6A

| | |
|---|---|
| Start time | 2005.11.23 19:00 |
| Ending time | 2005.11.23 19:54 |
| Channel | 60 |
| Title | Summer Vacation |
| Subtitle | "....." |
| Performer | XXX, YYY, ZZZ, ... |
| Category | Drama |
| Details | ..... |

FIG. 6B

| | |
|---|---|
| Start time | 2005.11.22 21:00 |
| Ending time | 2005.11.22 23:20 |
| Channel | 7 |
| Title | Wednesday Cinema |
| Subtitle | "King of Davide" |
| Performer | AAA, BBB, CCC, ... |
| Category | Cinema |
| Details | ..... |

INFORMATION PROCESSING APPARATUS AND INFORMATION PROCESSING METHOD FOR DETERMINING WHETHER TEXT INFORMATION OF AN OBTAINED ITEM SHOULD BE SUBJECT TO SPEECH SYNTHESIS BY COMPARING WORDS IN ANOTHER OBTAINED ITEM TO REGISTERED WORDS

BACKGROUND OF THE INVENTION

1. Field of the Invention

The present invention relates to an information processing apparatus for providing information.

2. Description of the Related Art

For provision of information by the Internet and broadcasts and provision of information stored in apparatuses in advance, the information is composed of one or more items which are written in a predetermined format. In general, an information providing apparatus provides a user with items necessary for provision of information by extracting the items from the information in accordance with the predetermined format. Concerning provision of information regarding a TV program, for example, electronic program information called EPG (electronic program guide) is written in a predetermined format. For each program, items such as a title, a subtitle, a performer, and a broadcast time are extracted from the EPG, and such items are provided to the user.

A technique is known in which information in the form of text to be provided is converted into synthesized speech information by speech synthesis, and the information is provided by means of synthesized speech. The information provision by means of synthesized speech eliminates the need for a step of displaying the information and draws a user's attention by means of sound, which are advantages of the information provision by means of synthesized speech when compared with the information provision by means of display.

In the information provision by means of synthesized speech described above, a large amount of information can take a considerable amount of time to be provided and provision of unnecessary information can unnecessarily distract a user's attention. To address these problems, attempts have been made to determine which information is to be provided by means of synthesized speech in accordance with attributes of an item, importance of contents of the information, or restrictions.

For example, Japanese Patent Laid-Open No. 05-165486 discloses a text-speech transforming device which has a table listing words forbidden from being broadcast to prevent phonetic output of words forbidden from being broadcast and which prevents read out of the words forbidden from being broadcast. Japanese Patent Laid-Open No. 09-288682 discloses an information selection speech output device in which information is composed of categorized items and only items having a keyword the same as that registered in advance are allowed to be read out.

When items of information that should be provided are apparent, text information of the items can be synthesized into speech and the speech is provided. However, when an item to be provided is not apparent, unnecessary information may be provided or necessary information may not be provided.

FIGS. 6A and 6B show examples of program information concerning programs. In FIGS. 6A and 6B, the program information is composed of eight items, that is, a start time, an ending time, a channel, a title, a subtitle, a performer, a category, and details. When a user requires information provision of a program title by means of synthesized speech, the information providing apparatus reads out an item corresponding to the program title. In FIG. 6A, the information providing apparatus can provide information regarding the title of a drama "Summer Vacation" as requested by a user. However, in FIG. 6B, since the title "Wednesday Cinema" does not specify the title of a movie, it is preferable to additionally provide a subtitle "King of Davide" by means of synthesized speech.

As described above, even if pieces of information are written in the same format, items which should be provided are not necessarily the same among the pieces of information. However, provision of all items increases the amount of information to be provided. In particular, since information provision by means of synthesized speech needs considerable time for reproducing synthesized speech information, reduction of the amount of information is required. In Japanese Patent Laid-Open No. 09-288682 mentioned above, items having a keyword are selected and subjected to speech synthesis for information provision. However, it is difficult to employ this method when there are a number of information names such as TV program names.

SUMMARY OF THE INVENTION

According to an aspect of the present invention, there is provided an information processing apparatus including obtaining means for obtaining information including a first item and a second item, determining means for determining whether the second item is to be subjected to speech synthesis by comparing the first item of the information obtained by the obtaining means with a registered word, and speech-synthesizing means for synthesizing an item other than the second item into speech when the determining means determines that the second item is not to be subjected to the speech synthesis and for synthesizing at least the second item into speech when the determining means determines that the second item is to be subjected to the speech synthesis.

When the determining means determines that the second item is to be subjected to the speech synthesis, the speech-synthesizing means can synthesize the first item and the second item into speech in combination.

When the determining means determines that the second item is to be subjected to the speech synthesis, the speech-synthesizing means can synthesize the first item into speech.

When a rate of the registered word in the first item is more than a prescribed threshold, the determining means can determine that the second item is to be subjected to the speech synthesis.

The information can be broadcast program information.

The first item can be a title of a program and the second item can be a subtitle of the program.

According to another aspect of the present invention, there is provided an information processing method including obtaining information including a first item and a second item, determining whether the second item is to be subjected to speech synthesis by comparing the first item of the obtained information with a registered word, and synthesizing an item other than the second item into speech when it is determined that the second item is not to be subjected to the speech synthesis and synthesizing at least the second item into speech when it is determined that the second item is to be subjected to the speech synthesis.

According to another aspect of the present invention, there is provided a control program allowing a computer to execute the information processing method.

According to yet another aspect of the present invention there is provided an information processing apparatus including an obtaining unit configured to obtain information including a first item and a second item, a determining unit configured to determine whether the second item is to be subjected to speech synthesis by comparing the first item of the information obtained by the obtaining unit with a registered word, and a speech-synthesizing unit configured to synthesize an item other than the second item into speech when the determining unit determines that the second item is not to be subjected to the speech synthesis, and for synthesizing at least the second item into speech when the determining unit determines that the second item is to be subjected to the speech synthesis.

Further features of the present invention will become apparent from the following description of exemplary embodiments with reference to the attached drawings.

BRIEF DESCRIPTION OF THE DRAWINGS

FIG. 4 is a table listing registered words according to the embodiment.

FIGS. 5A and 5B are views showing a method for obtaining a rate of registered words in an item by the information-provision-item determining unit.

FIGS. 6A and 6B are tables of program information.

DESCRIPTION OF THE EMBODIMENTS

Exemplary embodiments according to the present invention will now be described in detail hereinafter with reference to the accompanying drawings. Note that the components described in the embodiments are only exemplary and should not be considered as limiting the scope of the present invention.

First Exemplary Embodiment

Figure 1:
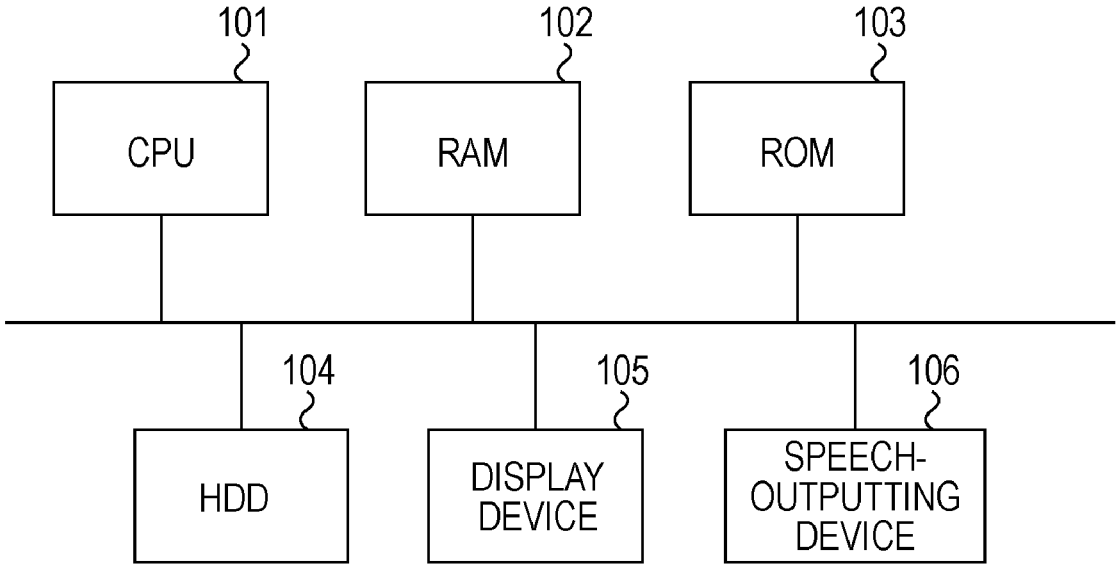
FIG. 1 is a block diagram showing a hardware configuration of an information processing apparatus according to an embodiment of the present invention.

FIG. 1 is a block diagram showing a hardware configuration of an information processing apparatus according to a first exemplary embodiment of the present invention. A central processing unit (CPU) 101 operates in response to each program describing an operation procedure of the information processing apparatus. The CPU 101 executes, for example, application programs, operating systems, control programs stored in a hard disk drive (HDD) 104, which will be described later, and controls the information processing apparatus to temporally store information necessary for executing programs and files in a random access memory (RAM) 102.

The RAM 102 serves as a storage area necessary for execution of the programs. The RAM 102 temporally stores a variety of data and serves as a main memory and a work area for the CPU 101. A read-only memory (ROM) 103 stores programs such as a basic input/output (I/O) program and a variety of data used in fundamental processing.

A hard disk drive (HDD) 104 serving as an external storage unit holds, for example, device information. Note that the configuration of the HDD 104 is not limited as long as the HDD 104 functions as an external storage device, and the HDD 104 may be constituted, for example, by a medium as a recording medium and an external storage drive accessible to the medium. Examples of such a medium include a flexible (floppy) disc (FD), a compact disc read only memory (CD-ROM), a compact disc recordable (CD-R), a compact disc rewritable (CD-RW), a PC card, a digital versatile disc (DVD), an integrated circuit (IC) memory card, a magneto-optical disc (MO), and a memory stick.

A display device 105 displays information stored in the HDD 104, for example. The display device 105 is implemented by, for example, a liquid crystal display (LCD), a cathode ray tube (CRT) display, an organic electroluminescence (EL) panel, or a surface-conduction electron-emitter display (SED). A speech-outputting device 106 includes a speaker.

In this embodiment, it is assumed that, each time a program according to this embodiment is executed, the program is loaded into the RAM 102 from the HDD 104 in which the program has been installed before execution of the program. However, embodiments of the present invention are not limited to this, and for example, programs and related data according to this embodiment may be directly loaded into the RAM 102 from a medium (not shown) before execution of the program. Alternatively, the program according to this embodiment may be recorded in the ROM 103 beforehand, and the ROM 103 may be configured to be part of a memory map so that the program may be directly executed by the CPU 101.

Figure 2:
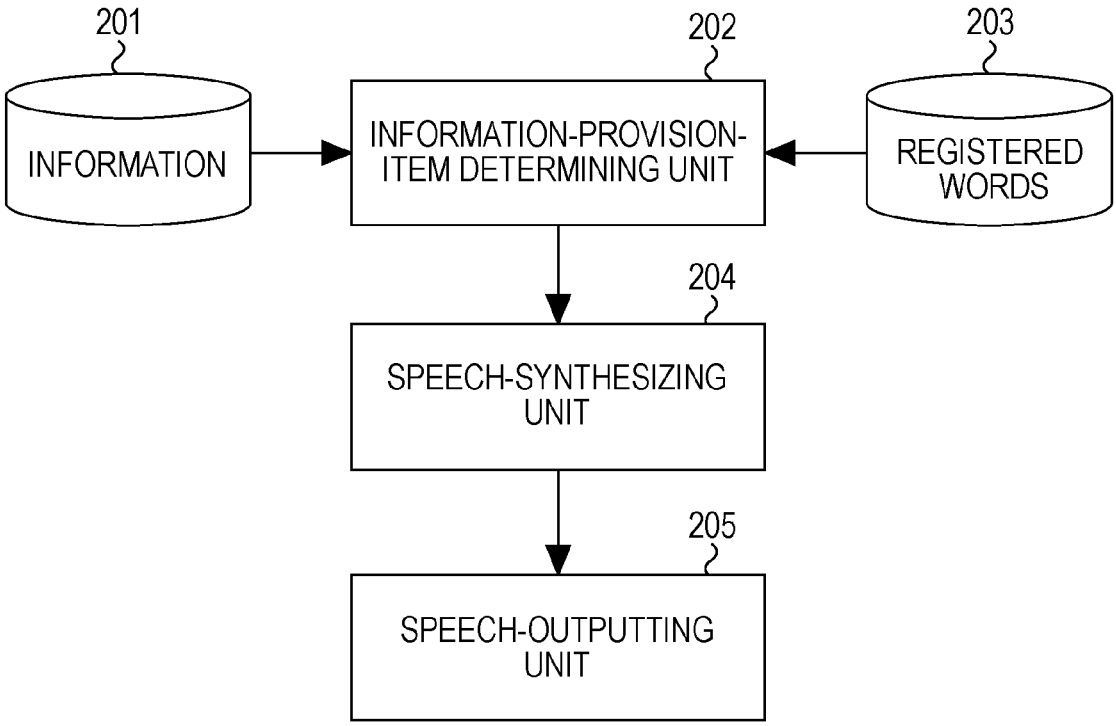
FIG. 2 is a block diagram showing a functional configuration of the information processing apparatus according to the embodiment.

FIG. 2 is a block diagram illustrating a functional configuration of an information processing apparatus according to the first embodiment. In FIG. 2, a database 201 stores information to be provided to a user, and each piece of information is divided into items. In this embodiment, a description will be made by taking pieces of program information shown in FIG. 6 as examples. An information-provision-item determining unit 202 determines whether or not a second item should be provided to the user on the basis of a first item. In this embodiment, a title in program information is used as a first item, and a subtitle is used as a second item. A registered word database 203 stores registered words for use in the determination performed by the information-provision-item determining unit 202. A speech-synthesizing unit 204 synthesizes text information received from the information-provision-item determining unit 202 into speech. A speech-outputting unit 205 outputs speech synthesized by the speech-synthesizing unit 204 corresponding to provision information.

Figure 3:
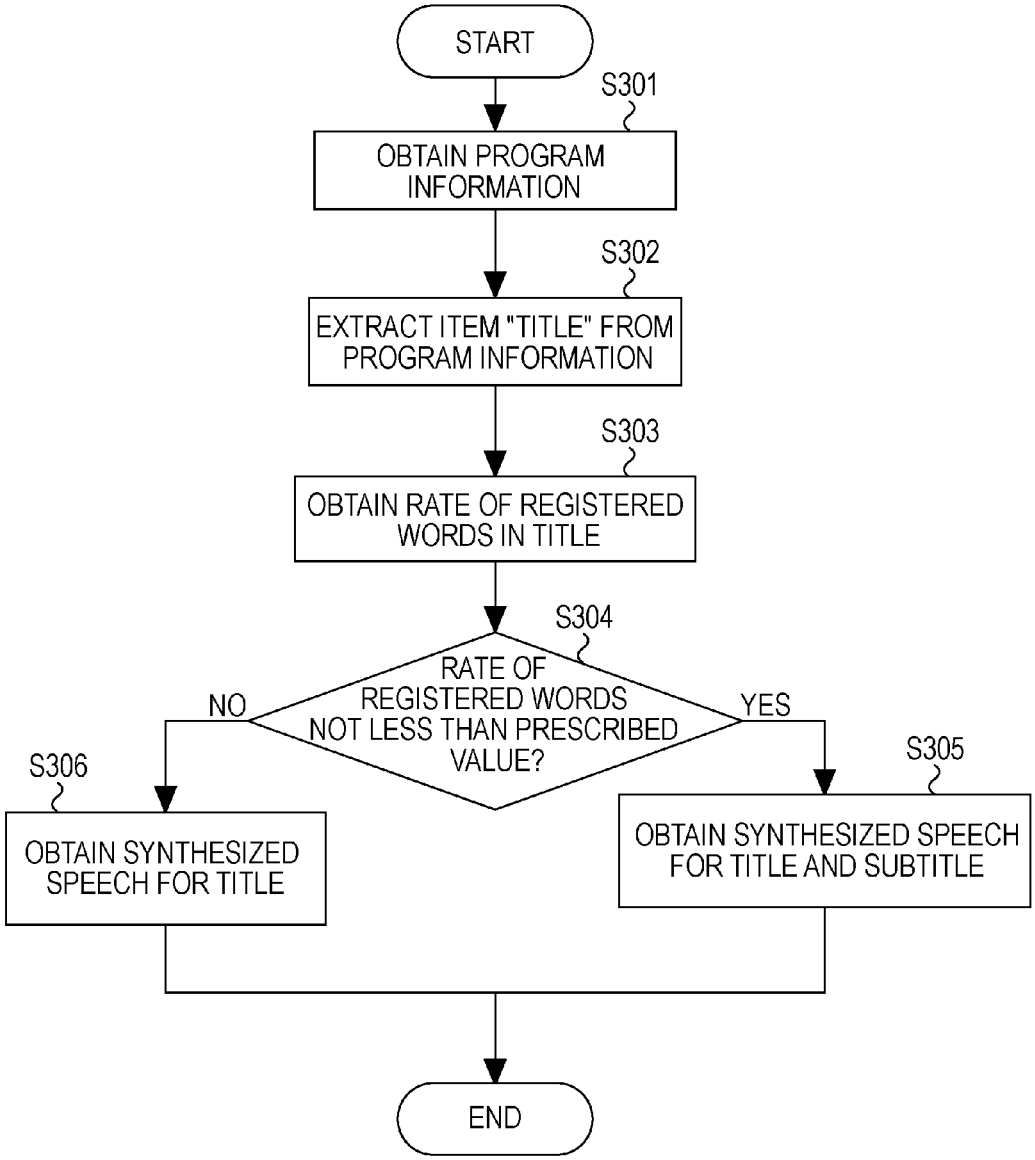
FIG. 3 is a flowchart illustrating an operation of an information-provision-item determining unit according to the embodiment.

FIG. 3 is a flowchart illustrating a process performed by the information-provision-item determining unit 202 according to the first embodiment. The process performed by the information-provision-item determining unit 202 is described with reference to FIGS. 2 and 3. In step S301, the information-provision-item determining unit 202 obtains program information from the database 201. In step S302, the information-provision-item determining unit 202 extracts a title as a first item from the program information.

In step S303, the rate of words in the title registered as registered words in the registered word database 203 is obtained. Examples of the registered words are shown in FIG. 4. The registered words should include words which are generally used in titles and should not specifically relate to one title, but the present invention is not limited to this. A method for obtaining the rate of registered words in step S303 will be described with reference to FIGS. 5A and 5B by taking each of the titles in FIGS. 6A and 6B, respectively, as examples.

Text information of the title is divided into words by a known method such as a morphological analysis. Then, each of the words of the title is compared with each of the registered words to obtain the rate of words matching the registered words in the all words of the title. FIG. 5A shows the rate of 0% for the title "Summer Vacation" shown in FIG. 6A and FIG. 5B shows the rate of 100% for the title "Wednesday Cinema" shown in FIG. 6B.

In step S304, when the rate of the registered words in the title is not less than a prescribed value, the process proceeds on to step S305 where text information of two items, the title and the subtitle, are synthesized into speech by the speech-synthesizing unit 204. When the rate of the registered words in the title is less than the prescribed value, the process proceeds to step S306 where text information of only the title is synthesized into speech by the speech-synthesizing unit 204. Assuming that the prescribed value is set to 70%, only the title "Summer Vacation" is synthesized into speech in step S306 in FIG. 5A, and the title "Wednesday Cinema" and the subtitle "King of Davide" are synthesized into speech in step S305 in FIG. 5B. Here, the title and the subtitle may be displayed on the display device 105.

As described above, a determination as to whether or not a subtitle is to be provided as information to a user is made according to the rate of the registered words in a title. The registered words should include words which are generally used in titles and should not specifically relate to one title so that the subtitle can be provided as information when the title is determined not to be unique information.

Second Exemplary Embodiment

In the first exemplary embodiment, determination as to whether or not text information of an item or items that should be synthesized into speech includes only a title or both a title and a subtitle is made in an operation of the information-provision-item determining unit 202. However, in the present invention, there is no such a restriction that at least text information of a title should be synthesized into speech. When text information of a subtitle is to be provided by means of synthesized speech, only text information of the subtitle can be provided by means of synthesized speech without providing text information of the title by means of synthesized speech. When text information of a subtitle is not to be provided by means of synthesized speech, text information of items other than a title can be provided by means of synthesized speech.

Third Exemplary Embodiment

In the first exemplary embodiment, the rate of the registered words in a title is obtained to determine whether or not text information of a subtitle is to be provided by means of synthesized speech. However, in the present invention, the determination is not necessarily made on the basis of the rate of the registered words. For example, information to be provided can be determined according to whether or not a title totally matches a word registered. Alternatively, information to be provided can be determined according to whether or not at least one of the registered words is included in a title.

Fourth Exemplary Embodiment

In the first exemplary embodiment, program information is taken as an example of information, and the determination as to whether or not text information of a subtitle is to be provided by means of synthesized speech in addition to text information of a title is made on the basis of the relationship between text information of a title and registered words. However, the present invention is not limited to this. The information is not necessarily the program information as long as the information can be divided into items. The items are not limited to a title and a subtitle, and any other items can be employed.

Fifth Exemplary Embodiment

In the first exemplary embodiment, text information of an item is synthesized into speech. However, the present invention is not limited to this. The text information of the item can be displayed instead of being synthesized into speech. In this case, the information-provision-item determining unit 202 determines whether or not the subtitle is an object to be output by means of display instead of by means of synthesized speech. When the subtitle is determined to be the display object, only the subtitle or both of the subtitle and the title are output to be displayed on the display device 105. When the subtitle is determined not to be the display object, only the title is displayed on the display device 105. It is an advantage of this configuration that, when a display area is small, the display area is not disadvantageously occupied by more information than necessary, that is, only necessary information can be displayed.

Other Embodiments

An aspect of the present invention can be achieved as follows. A storage medium which stores program code (software) implementing the functions described in the foregoing embodiments is installed into a system or an apparatus. A computer (or a CPU or a micro-processing unit (MPU)) of the system or the apparatus reads out the program code stored in the storage medium to execute the program code.

In this case, the program code read out from the storage medium implements the functions of the foregoing embodiments. The present invention includes the storage medium storing the program codes.

Examples of a storage medium providing program code include a flexible disc, a hard disk, an optical disc, a magneto-optical disc, a CD-ROM, a CD-R, a magnetic tape, a nonvolatile memory card, and a ROM.

Embodiments according to the present invention are not limited to the cases where the functions described in the foregoing embodiments can be attained by executing the program code read out by the computer. For example, an operating system (OS) operating on the computer can execute part of or all of the actual processing to achieve the functions of the foregoing embodiments.

Furthermore, the functions of the embodiments according to the present invention can be achieved as follows. The program code read out from the storage medium is written in a function expansion board incorporated in the computer or written in a memory included in a function expansion unit connected to the computer. A CPU included in the function expansion board or the function expansion unit can perform part of or all of the actual processing in accordance with commands of the program code.

In the present invention, determining means refers to the information-provision-item determining unit 202 of the foregoing embodiments. In the foregoing embodiments, an example is shown in which the first item and the second item refer to the title and the subtitle, respectively, and the determining means compares the title with the words registered in the database 203, whereby a determination is made as to whether or not the subtitle is to be subjected to speech synthesis. The first embodiment shows an example in which, in the information-provision-item determining unit 202, when the rate of the registered words in the title is less than the prescribed value, text information of the subtitle is not subjected to the speech synthesis but text information of the title is synthesized into speech. Furthermore, when the rate of the registered words in the title is not less than the prescribed value, both of the text information of the title and the subtitle are synthesized into speech. Note that, in this case, only the text information of the subtitle may be subjected to the speech synthesis, that is, at least the text information of the subtitle is subjected to the speech synthesis.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-372429 filed Dec. 26, 2005, which is hereby incorporated by reference herein in its entirety.

What is claimed is:

1. An information processing apparatus, comprising:

an obtaining unit configured to obtain information including a first item and a second item;

a storing unit configured to store a registered word;

an analyzing unit configured to perform a morphological analysis of the first item, and to obtain one word or a plurality of words included in the first item;

an acquiring unit configured to acquire a rate of obtained words that match the registered words;

a determining unit configured to determine whether the second item is to be subjected to speech synthesis by comparing the rate acquired by the acquiring unit to a prescribed value, wherein if a plurality of words are included in the first item and the rate is equal to or higher than the prescribed value, the determining unit determines that the second item is to be subjected to speech synthesis, and wherein if a plurality of words are included in the first item and the rate is lower than the prescribed value, the determining unit determines that the second item is not to be subjected to speech synthesis; and a speech-synthesizing unit configured to synthesize the first item into speech when the determining unit determines that the second item is not to be subjected to speech synthesis, and to synthesize both the first item and the second item into speech when the determining unit determines that the second item is to be subjected to speech synthesis.

2. The information processing apparatus according to claim 1, wherein the information is broadcast program information, the first item is a title of a program, and the second item is a subtitle of the program.

3. An information processing method, comprising:

obtaining information including a first item and a second item;

storing a registered word;

performing a morphological analysis of the first item to obtain at least one word included in the first item;

acquiring an acquired number that represents the number of obtained words that match stored registered words;

determining whether the second item is to be subjected to speech synthesis by comparing the acquired number to a prescribed value, wherein if a plurality of words are included in the first item and the rate is equal to or higher than the prescribed value, the determining unit determines that the second item is to be subjected to speech synthesis, and wherein if a plurality of words are included in the first item and the rate is lower than the prescribed value, the determining unit determines that the second item is not to be subjected to speech synthesis; and synthesizing the first item into speech when it is determined that the second item is not to be subjected to speech synthesis, and synthesizing both the first item and the second item into speech when it is determined that the second item is to be subjected to speech synthesis.

4. A storage medium for storing a program configured to cause a computer to realize the information processing method according to claim 3 by executing the program.

5. An information processing apparatus, comprising:

an obtaining unit configured to obtain information including a first item and a second item;

a storing unit configured to store a registered word;

an analyzing unit configured to perform a morphological analysis of the first item to obtain at least one word included in the first item;

an acquiring unit configured to acquire an acquired number that represents the number of obtained words that match stored registered words;

a determining unit configured to determine whether the second item is to be subjected to speech synthesis by comparing the acquired number to a prescribed value, wherein if a plurality of words are included in the first item and the rate is equal to or higher than the prescribed value, the determining unit determines that the second item is to be subjected to speech synthesis, and wherein if a plurality of words are included in the first item and the rate is lower than the prescribed value, the determining unit determines that the second item is not to be subjected to speech synthesis; and a speech-synthesizing unit configured to synthesize the first item into speech when the determining unit determines that the second item is not to be subjected to speech synthesis, and to synthesize both the first item and the second item into speech when the determining unit determines that the second item is to be subjected to speech synthesis.

* * * * *